US006837233B1

(12) United States Patent
Spencer-Smith

(10) Patent No.: US 6,837,233 B1
(45) **Date of Patent: *Jan. 4, 2005**

(54) SYSTEM FOR ENHANCING PERFORMANCE OF AN INTERNAL COMBUSTION ENGINE

(76) Inventor: Michael Spencer-Smith, 1265 Olive Hill La., Napa, CA (US) 94558

( * ) Notice: Subject to any disclaimer, the term of this patent is extended or adjusted under 35 U.S.C. 154(b) by 0 days.

This patent is subject to a terminal disclaimer.

(21) Appl. No.: 10/696,479

(22) Filed: Oct. 29, 2003

Related U.S. Application Data

(60) Provisional application No. 60/423,732, filed on Nov. 4, 2002.

(51) Int. Cl.[7] ..... F02B 23/00
(52) U.S. Cl. ..... 123/694; 123/681; 123/488
(58) Field of Search ..... 123/694, 696, 123/695, 488, 687, 679, 689, 681, 682, 683

(56) References Cited

U.S. PATENT DOCUMENTS

| | | | | |
|---|---|---|---|---|
| 4,202,301 A | | 5/1980 | Early et al. | |
| 4,479,464 A | | 10/1984 | Kondo et al. | |
| 4,889,098 A | * | 12/1989 | Suzuki et al. | 123/678 |
| 4,942,848 A | * | 7/1990 | Terasaka | 123/1 A |
| 5,033,438 A | | 7/1991 | Feldinger et al. | |
| 5,036,470 A | * | 7/1991 | Suzuki et al. | 701/109 |
| 5,251,604 A | | 10/1993 | Kaneko et al. | |
| 5,777,204 A | | 7/1998 | Abe | |
| 5,836,153 A | | 11/1998 | Staufenberg et al. | |
| 6,260,547 B1 | | 7/2001 | Spencer-Smith | |

FOREIGN PATENT DOCUMENTS

| | | |
|---|---|---|
| GB | 2077962 | 12/1981 |
| GB | 2093228 | 8/1982 |

* cited by examiner

*Primary Examiner*—John T. Kwon
(74) *Attorney, Agent, or Firm*—Thomas R. Lampe

(57) ABSTRACT

A system for improving the performance of a motor vehicle internal combustion engine includes a controller positioned between an $O_2$ sensor. The controller alters the $O_2$ sensor signals and adjusts supplemental sensor signals received from supplemental sensors and sends the altered $O_2$ signals and the adjusted supplemental sensor signals to a programmed electronic control unit which controls operation of fuel injectors.

15 Claims, 5 Drawing Sheets

| |
|---|
| Fig. 3A |
| Fig. 3B |
| Fig. 3C |

SYSTEM FOR ENHANCING PERFORMANCE OF AN INTERNAL COMBUSTION ENGINE

This application is based on and claims the benefit of U.S. Provisional Patent Application No. 60/423,732, filed on Nov. 4, 2002.

TECHNICAL FIELD

This invention relates to a method and apparatus for enhancing the performance of an internal combustion engine, in particular the internal combustion engine of a vehicle.

BACKGROUND OF THE INVENTION

The use of an $O_2$ sensor to sense the amount of $O_2$ in the exhaust of an automobile or other motor vehicle and to send sensor signals to an electronic control unit or module (ECU) also incorporated in the motor vehicle is well known. The terms "electronic control unit", "module", "electronic control module" and "ECU" are interchangeable as employed herein. The ECU is associated with the fuel injector system of the engine to control the air/fuel mixture introduced into the engine cylinders. With the fuel system in closed loop operation after the $O_2$ sensor warms up, the $O_2$ sensor voltage cycles up and down. This cycling (which varies in speed between idling and cruising) occurs because the ECU senses the $O_2$ voltage and then changes the pulse width of the signal driving the fuel injector on and off. This switching action allows the ECU to perform minor adjustments to the air/fuel ratio to allow the catalytic converter to perform its job to optimize the "oxidation" of carbon monoxide and hydrocarbons as well as the reduction of nitrogen oxides. The oxidation occurs when the mixture is slightly lean and more oxygen is available, and the reduction occurs when the mixture is slightly rich and less oxygen is available.

It is known to modify the function of an existing electronic control unit or module (ECU) by physically changing the functional parameters of the programmable eprom or computer chip, or changing the existing eprom itself inside the ECU, in an attempt to improve engine performance.

Various problems can arise when an existing ECU is modified as indicated above. The physically changed or new eprom must be specific to a manufacturer's application, and during use it may cause knocking, lean misfires, uncontrolled parameters during timed sequences and the signaling of alarming trouble codes in vehicles with on-board diagnostic (OBD) systems.

My U.S. Pat. No. 6,260,547, issued Jul. 17, 2001, discloses use of a controller interposed between an $O_2$ sensor and a preprogrammed electronic control unit employed in the motor vehicle to provide a richer fuel mixture than would normally be the case and thus boost the performance of the engine.

The following United States patents and foreign patent documents are cited in U.S. Pat. No. 6,260,547: U.S. Pat. No. 5,836,153, issued Nov. 17, 1998, U.S. Pat. No. 5,777,204, issued Jul. 7, 1998, U.S. Pat. No. 4,479,464, issued Oct. 30, 1984, U.S. Pat. No. 4,202,301, issued May 13, 1980, U.S. Pat. No. 5,033,438, issued Jul. 23, 1991, U.S. Pat. No. 5,251,604, issued Oct. 12, 1993, British Patent No. 2,077,962, dated December, 1981 and British Patent No. 2,093,228, Granted August, 1982.

The invention disclosed in my U.S. Pat. No. 6,260,547 alters the $O_2$ sensor signal voltage to the ECU. The ECU responds to this altered signal by widening the pulse width to the injectors thereby enriching the air/fuel ratio during the combustion process. The ECU has a fuel map which has pre-determined fuel values which are influenced by factors such as RPM, manifold absolute pressure (MAP), engine temperature, intake air temperature, and throttle position. These fluctuating parameters or variable operational factors relating to the operation of the internal combustion engine influence the points on the map that the ECU uses to send out a predetermined electrical pulse width to open the fuel injectors which is then fine tuned by the corrective signal from the $O_2$ sensor to a pre-set air/fuel ratio.

In the arrangement disclosed in U.S. Pat. No. 6,260,547, the $O_2$ sensor signal is altered a specific or pre-set percentage (depending on the enrichment setting used) throughout the entire ECU fuel map without adjusting for fluctuating manifold absolute pressure or other of the above-indicated influences. As a result, the percentage of enrichment by current technology remains fixed whether the ECU map is influenced by additional parameters as stated above or not. Because these additional variable operational factors relating to the operation of the internal combustion engine continuously change and influence the ECU's fuel map when responding to the $O_2$ sensor signal, a minor fluctuation occurs in the specific air/fuel ratio as pre-set.

DISCLOSURE OF INVENTION

In order to precisely maintain an optimum or specific air/fuel ratio, the invention disclosed and claimed herein provides for the adjustment of the percentage of enrichment to synchronize with the above-described additional influencing parameters, as well as possibly others. The invention allows a more varied and precisely controlled air/fuel ratio throughout the entire operational range of the ECU and during varying loads and engine speeds.

The apparatus of the invention is for improving the performance of the internal combustion engine of a motor vehicle having fuel injectors. The invention incorporates basic closed loop control but utilizes the $O_2$ sensor voltage to adjust selected sensors before being sent to the electronic control unit. The ECU senses the altered sensor voltages and changes the enrichment rate according to specified programmed look up tables (MAP). The apparatus includes an $O_2$ sensor for sensing the amount of $O_2$ in exhaust produced by the internal combustion engine, at least one supplemental sensor for sensing a variable operational factor relating to the operation of the internal combustion engine, and a programmed electronic control unit for receiving $O_2$ sensor signals from the $O_2$ sensor.

The apparatus further includes a controller for receiving and altering the $O_2$ sensor signals from the $O_2$ sensor prior to the $O_2$ sensor signals being received by the electronic control unit. The at least one supplemental sensor is directly operatively connected to the controller and sends supplemental sensor signals to the controller. The controller adjusts the supplemental sensor signals and sends the adjusted supplemental sensor signals to the electronic control unit. The electronic control unit, in response to receipt of the altered $O_2$ sensor signals and the adjusted supplemental sensor signals produces modified fuel injector control signals controlling operation of said fuel injectors.

The invention also encompasses a method.

Other features, advantages and objects of the present invention will become apparent with reference to the following description and accompanying drawings.

BEST MODE FOR CARRYING OUT THE INVENTION

Figures 1, 3:
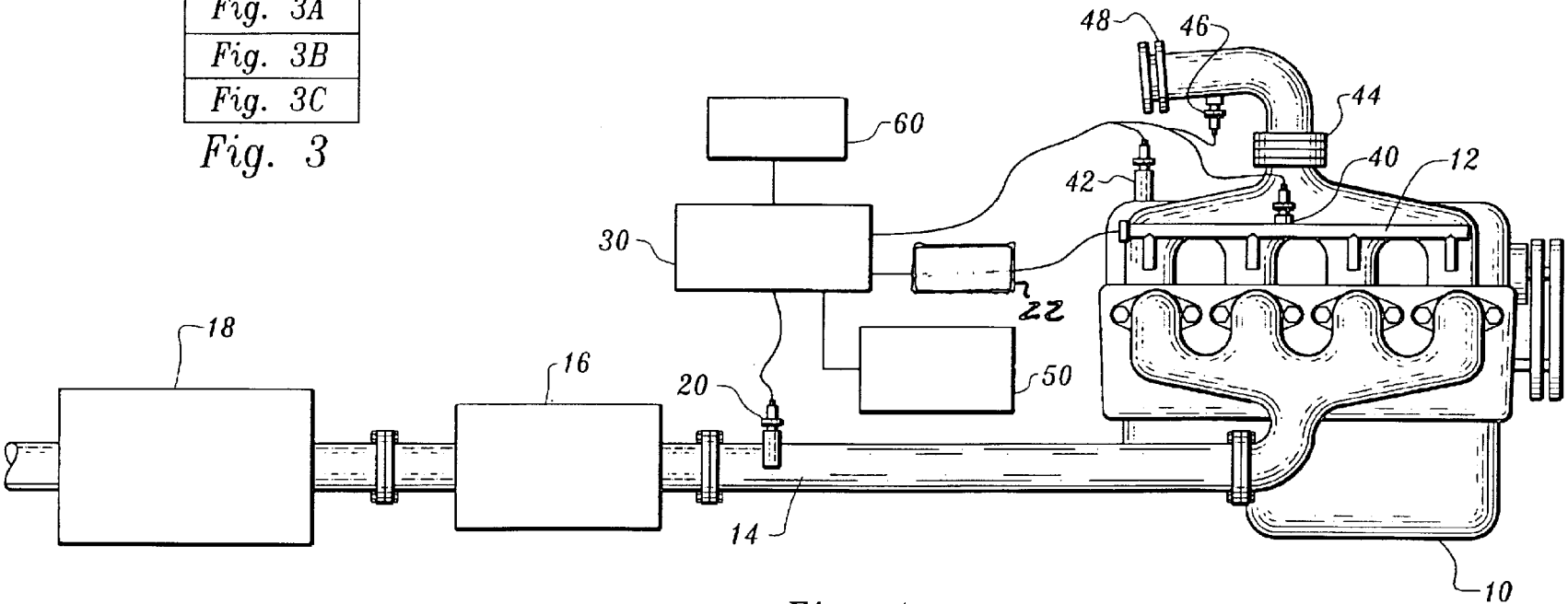
FIG. 1 is a diagrammatic representation illustrating an internal combustion engine and exhaust system having an $O_2$ sensor, a plurality of supplemental sensors, an ECU and a controller for altering $O_2$ sensor signals and supplemental sensor signals.
FIG. 3 is a detailed circuit diagram of a controller for carrying out the teachings of the present invention.

FIG. 1 illustrates a conventional motor vehicle internal combustion engine 10 having fuel injectors 12. An exhaust pipe 14 extends from the engine 12, a catalytic converter 16 and a muffler 18 being operatively associated with the exhaust pipe in a conventional fashion.

An $O_2$ sensor (also known as a lamda sensor) 20 of conventional construction is employed for sensing the amount of $O_2$ in the exhaust passing through exhaust pipe 14. Also, as is conventional, an electronic control unit or module (ECU) 22 is operatively associated with fuel injectors 12, the electronic control unit being pre-programmed and receiving sensor signals from $O_2$ sensor 20.

In response to the sensor signals, the electronic control unit produces fuel injector control signals controlling operation of the fuel injectors, in accordance with the pre-programming of the electronic control unit.

As described in more detail in my U.S. Pat. No. 6,260,547, the fuel injectors operate in a pulsed manner, the air/fuel pulses resulting from the associated electronic control unit having a wave form. The upper and lower portions of the normal wave form are substantially of the same magnitude and respectively in a rich zone and a lean zone on opposed sides of a pre-determined stoichiometric line representing a set stoichiometric air/fuel mixture. That is, in a conventional arrangement the pulse portions fall generally evenly in the rich and lean zones so that the desired overall average stoichiometric value is attained or closely approximated. The preset programming of the electronic control unit may not be such as to optimize the operation of the internal combustion engine with which the electronic control unit is associated, and in accordance with the invention of my U.S. Pat. No. 6,260,547, a controller is interposed between the $O_2$ sensor and the pre-programmed electronic control unit to modify the sensor signals from the $O_2$ sensor to produce modified sensor signals.

These modified sensor signals are transmitted from the controller to the electronic control unit and result in the electronic control unit generating modified fuel injector control signals. These modified fuel injector control signals cause the fuel injectors to provide a richer fuel mixture to the internal combustion engine over a period of time than would be provided in the absence of the step of modifying the sensor signals from the $O_2$ sensor.

The apparatus of the present invention also utilizes a controller interposed between the $O_2$ sensor and the programmed electronic control unit. The controller is identified by reference numeral 30. FIG. 3 illustrates circuitry and components of a form of controller 30 which may be employed in the present invention. As is the case with the controller disclosed in my U.S. Pat. No 6,260,547, the controller 30 also serves to receive $O_2$ sensor signals from the $O_2$ sensor and alters the $O_2$ sensor signals prior to the $O_2$ sensor signals being received by the electronic control unit. The electronic control unit responds to this altered signal by widening the pulse width to the injectors thereby enriching the air/fuel ratio during the combustion process, as described in my afore-referenced patent.

Figure 2:
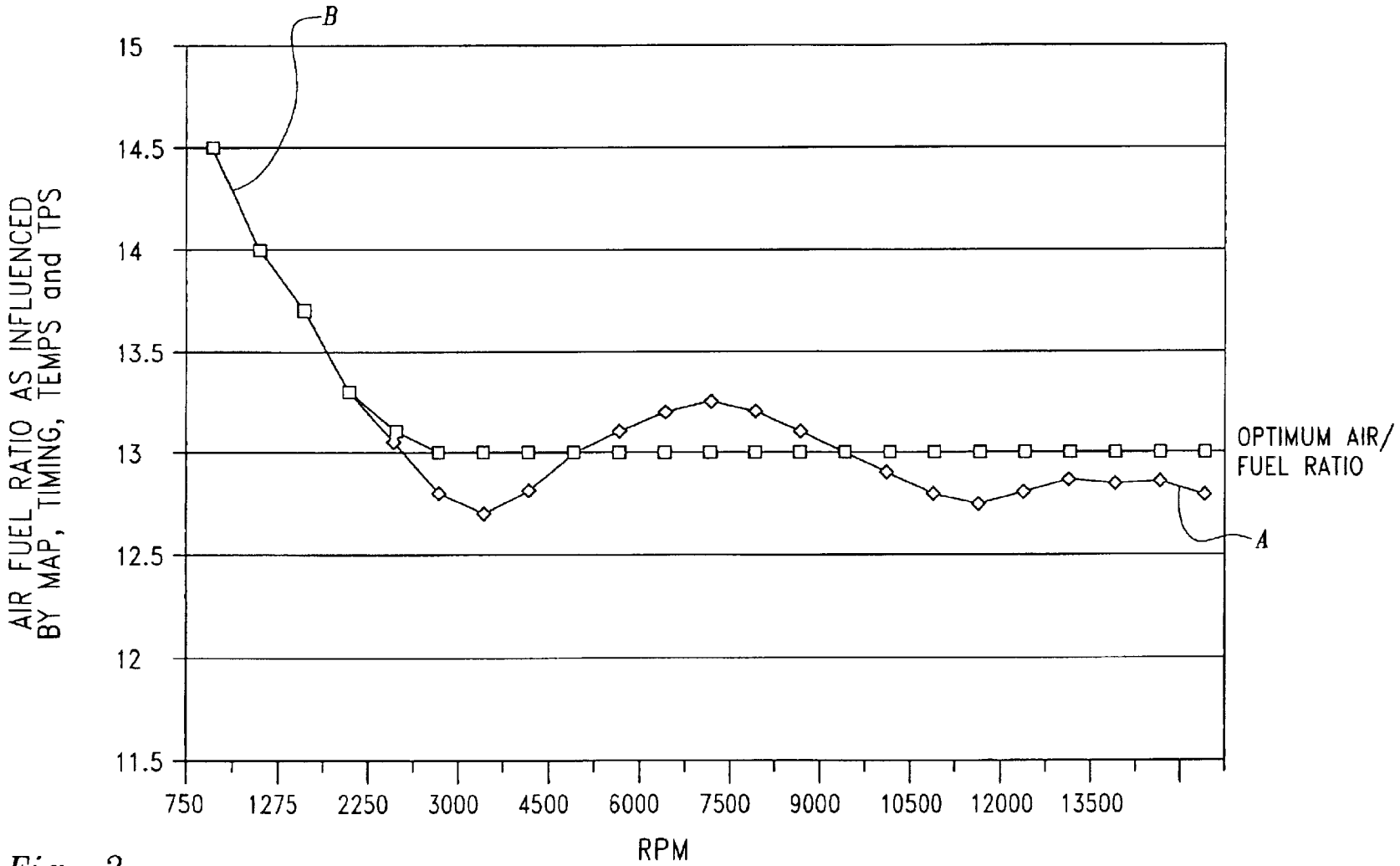
FIG. 2 depicts a representative ECU fuel map graphically illustrating air/fuel ratios at different RPMs for an internal combustion engine not incorporating the present invention and an internal combustion engine incorporating the invention.
Figure 3A:
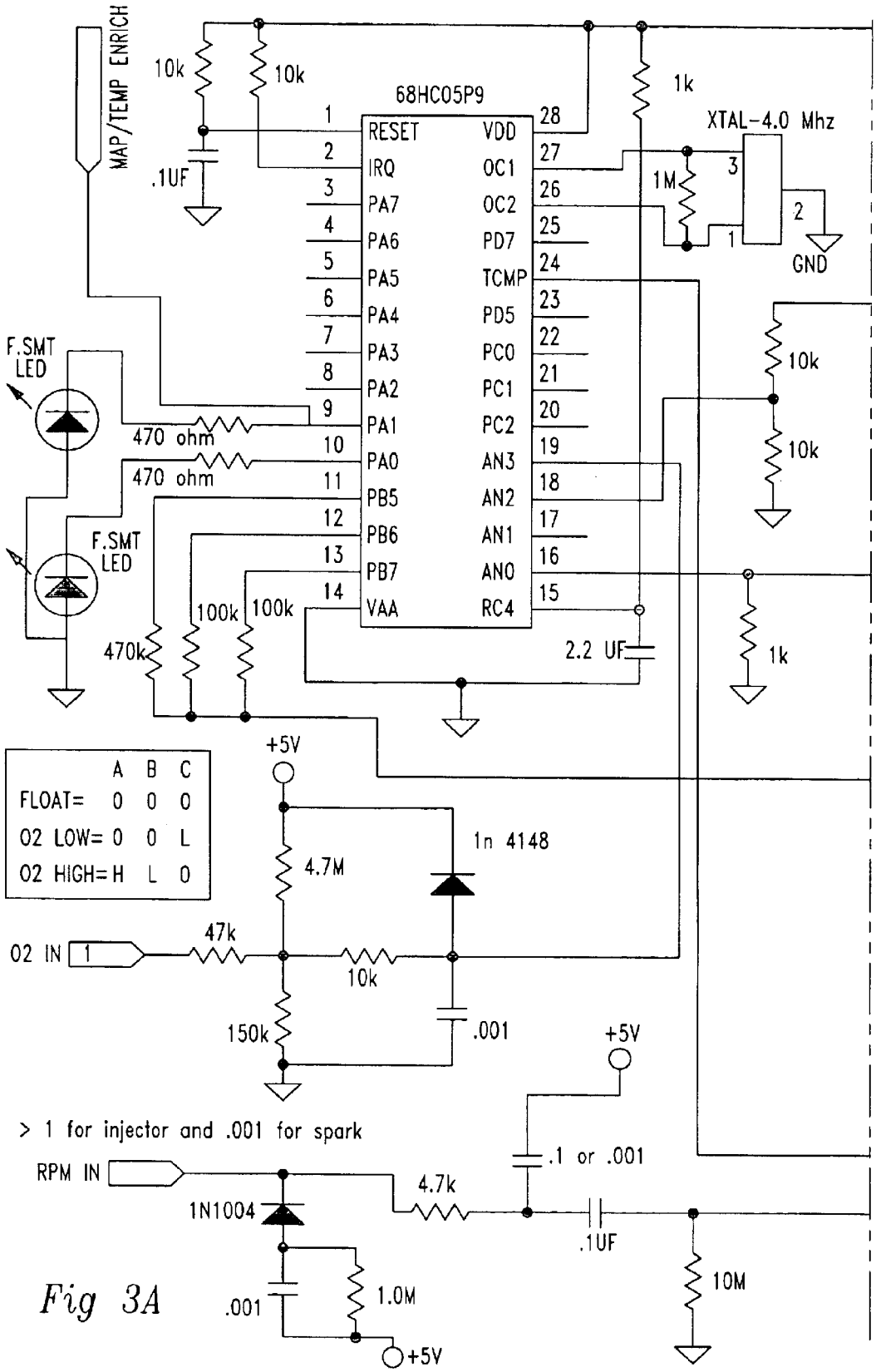
Figure 3B:
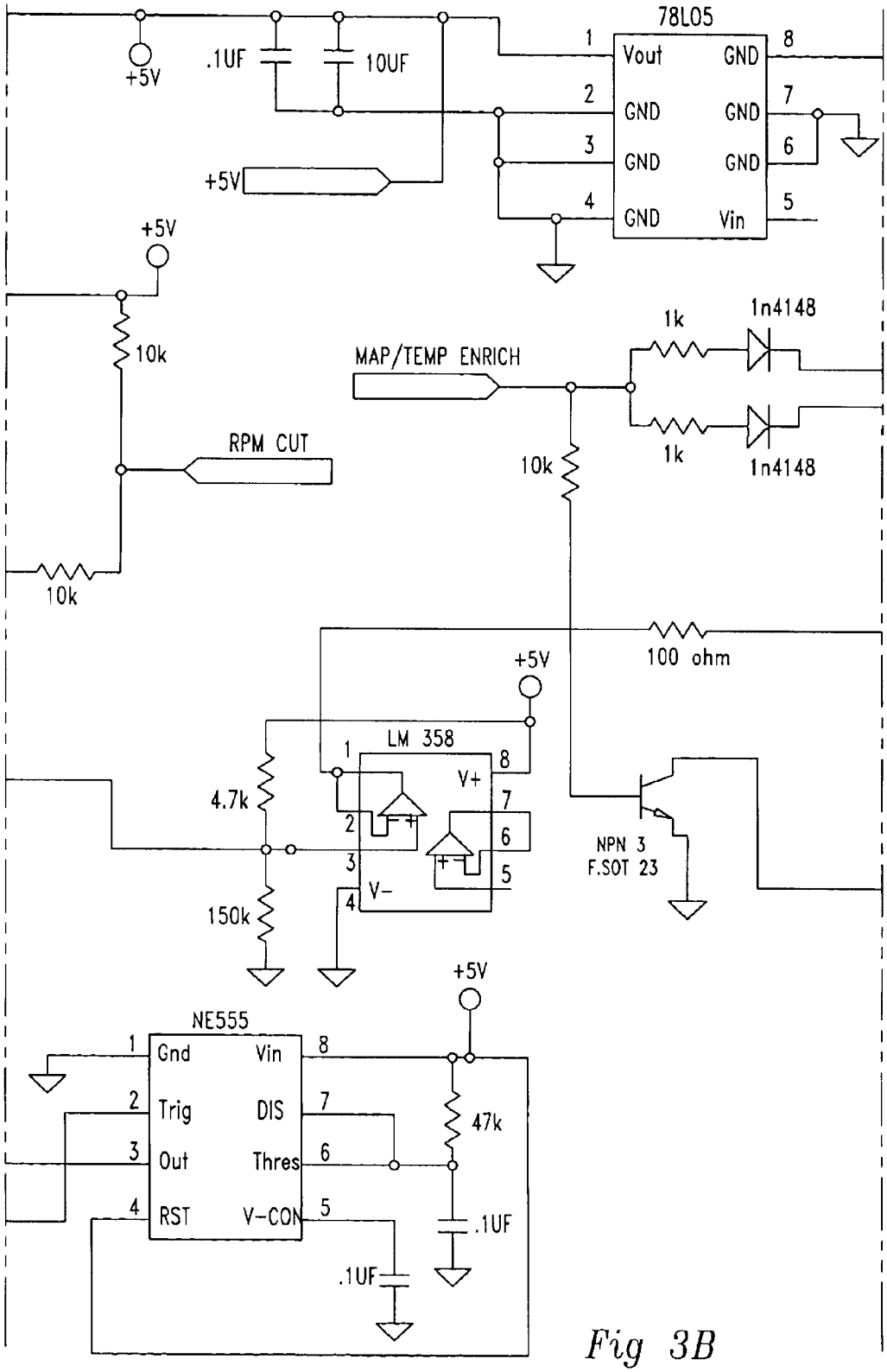
Figure 3C:
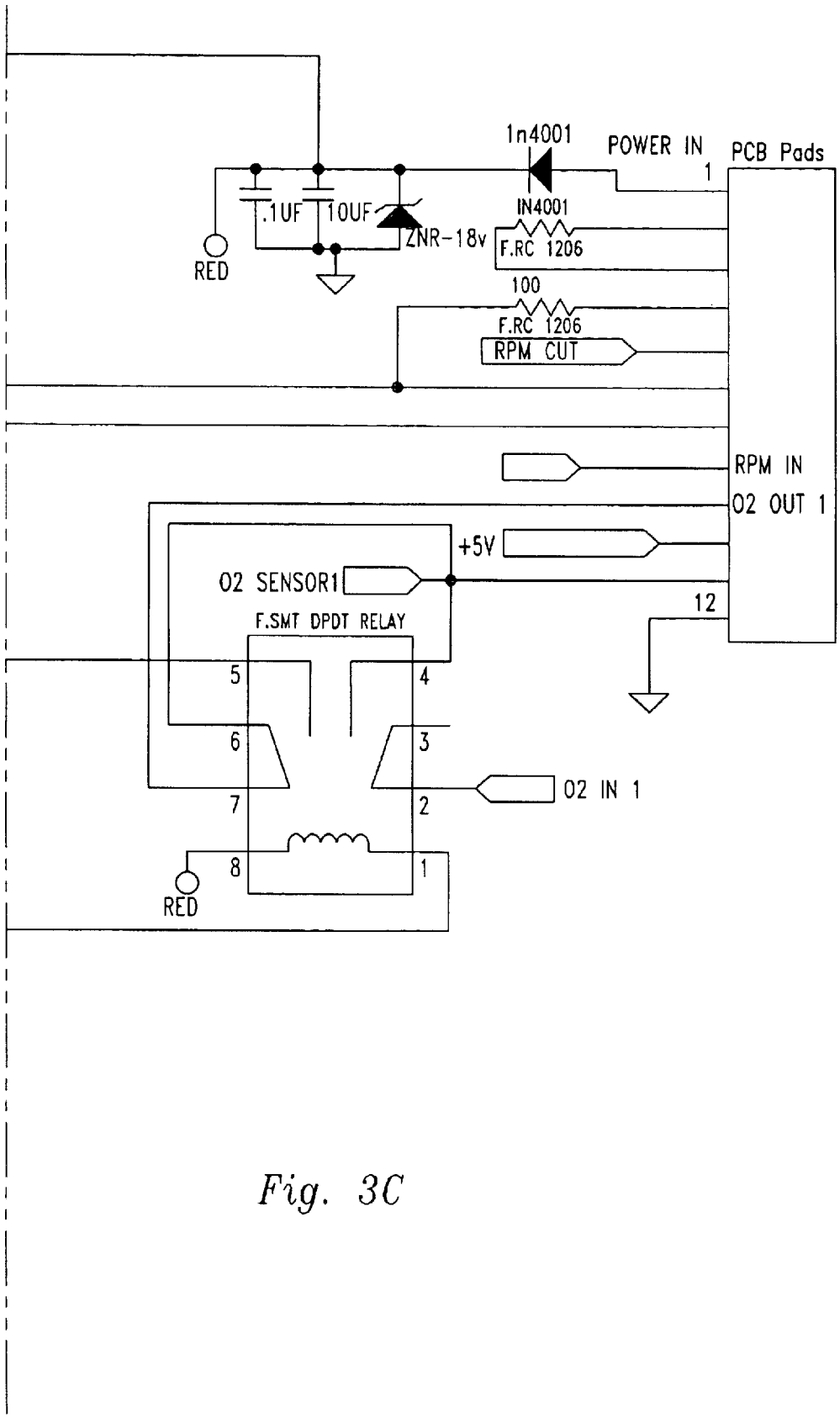

The electronic control unit has a fuel map, a representative form of which is shown in FIG. 2. The fuel map has pre-determined fuel values which are influenced by factors such as RPM, manifold absolute pressure (MAP), engine temperature, intake air temperature and throttle position. These fluctuating parameters or variable operational factors relating to the operation of the internal combustion engine influence the points on the map that the electronic control unit uses to send out a pre-determined electrical pulse width to open the fuel injectors as having been fine tuned by the corrective signal from the $O_2$ sensor to a pre-set air/fuel ratio.

A limitation in the technology disclosed in U.S. Pat. No. 6,260,547 exists in that the technology alters the $O_2$ sensor signal voltage a specific or pre-set percentage (depending on the enrichment setting used) throughout the entire ECU fuel map without adjusting for fluctuating manifold absolute pressure or the other above-indicated influences. As a result, the percentage of enrichment will remain fixed whether the ECU map is influenced by the additional above-stated variable operational factors or not. Because these additional influencing parameters constantly change and influence the ECU's fuel map when responding to the $O_2$ sensor signal, a minor fluctuation occurs in the specific air/fuel ratio as pre-set. In order to precisely maintain an optimum or specific air/fuel ratio, the invention disclosed and claimed herein adjusts its percentage of enrichment to synchronize with these additional influencing parameters.

Referring to FIG. 1, these fluctuating or variable operational factors relating to the operation of the internal combustion engine 10 are generated by supplemental sensors, in this arrangement manifold absolute pressure sensor 40, engine temperature sensor 42, throttle position sensor 44, intake air temperature sensor 46, mass air flow sensor 48 and RPM sensor 50.

The supplemental sensor signals received from supplemental sensors 40, 42, 44, 46, 48, 50 are directly received by controller 30. The controller 30 selectively alters the supplemental sensor signals prior to the supplemental sensor signals being received by the electronic control unit 22. A switch 60 may be associated with the controller 30 so that an operator can turn the controller on or off manually. If turned off, the $O_2$ sensor signals and the supplemental sensor signals can pass straight through to the electronic control unit.

The apparatus incorporates basic closed loop control but utilizes the $O_2$ sensor both as a corrective and driving device which monitors $O_2$ sensor voltage to adjust selected supplemental sensor signals before being passed on to the electronic control unit. The ECU senses the altered supplemental sensor voltages created by the controller and changes the enrichment rate according to specified programmed look up tables (MAP). These controlled sensors include, but are not necessarily limited to, supplemental sensors 40, 42, 44, 46, 48, 50. The new areas of the look up tables due to modified sensor output affect the length of time that voltage is sent to the injectors 12 (pulse width) for a varied fuel amount delivery to attain the desired air fuel ratio.

This system of control provides infinite voltage control of the above-referenced sensors so that optimum air/fuel ratios can be precisely maintained under all driving and load conditions and throughout the entire operational range of the ECU.

The representative fuel map shown in FIG. 2 illustrates how the present invention can be utilized to attain an optimum air/fuel ratio. The graph designated by the letter A is representative of that produced by a motor vehicle internal combustion engine without use of the present invention but employing that of my U.S. Pat. No. 6,260,547. The graph designated by reference letter B is produced by a motor vehicle internal combustion engine utilizing the teachings of the present invention.

The invention claimed is:

1. Apparatus for improving the performance of the internal combustion engine of a motor vehicle having fuel injectors, said apparatus comprising in combination:

an $O_2$ sensor for sensing the amount of $O_2$ in exhaust produced by said internal combustion engine;

at least one supplemental sensor for sensing a variable operational factor relating to the operation of said internal combustion engine;

a programmed electronic control unit for receiving $O_2$ sensor signals from said $O_2$ sensor; and a controller for altering the $O_2$ sensor signals from said $O_2$ sensor prior to the $O_2$ sensor signals being received by said electronic control unit, said at least one supplemental sensor directly operatively associated with said controller and sending supplemental sensor signals to said controller and said controller adjusting said sensor signals and sending the adjusted supplemental sensor signals to said electronic control unit, said electronic control unit in response to receipt thereof of both said altered $O_2$ sensor signals from said $O_2$ sensor and of said adjusted supplemental sensor signals producing modified fuel injector control signals controlling operation of said fuel injector.

2. The apparatus according to claim 1 for improving the performance of the internal combustion engine of a motor vehicle including a plurality of supplemental sensors for sensing a plurality of variable operational factors relating to the operation of said internal combustion engine and wherein said controller directly receives supplemental sensor signals from said plurality of supplemental sensors and adjusts the supplemental sensor signals from said plurality of supplemental sensors prior to the supplemental sensor signals thereof being received by said electronic control unit.

3. The apparatus according to claim 1 for improving the performance of the internal combustion engine of a motor vehicle wherein said supplemental sensor is a manifold absolute pressure sensor, said controller adjusting the sensor signals of said manifold absolute pressure sensor.

4. The apparatus according to claim 1 for improving the performance of the internal combustion engine of a motor vehicle wherein said supplemental sensor is an RPM sensor, said controller adjusting the sensor signals of said RPM sensor.

5. The apparatus according to claim 1 for improving the performance of the internal combustion engine of a motor vehicle wherein said supplemental sensor is an engine temperature sensor, said controller adjusting the sensor signals of said engine temperature sensor.

6. The apparatus according to claim 1 for improving the performance of the internal combustion engine of a motor vehicle wherein said supplemental sensor is an intake air temperature sensor, said controller adjusting the sensor signals of said air temperature sensor.

7. The apparatus according to claim 1 for improving the performance of the internal combustion engine of a motor vehicle wherein said supplemental sensor is a throttle position sensor, said controller adjusting the sensor signals of said throttle position sensor.

8. A method for improving the performance of the internal combustion engine of a motor vehicle having fuel injectors, an $O_2$ sensor for sensing the amount Of $O_2$ in exhaust produced by said internal combustion engine, at least one supplemental sensor for sensing a variable operational factor relating to the operation of said internal combustion engine and a programmed electronic control unit for receiving sensor signals from said $O_2$ senor, said method comprising the steps of:

altering $O_2$ sensor signals produced by the $O_2$ sensor;

adjusting supplemental sensor signals produced by said at least one supplemental sensor;

sending the altered $O_2$ sensor signals to the electronic control unit;

sending the adjusted supplemental sensor signals to the electronic control unit; and at said electronic control unit, producing modified fuel injector control signals responsive to receipt of both said altered $O_2$ sensor signals and said adjusted supplemental sensor signals to control operation of said fuel injectors.

9. The method according to claim 8 wherein said motor vehicle includes a plurality of supplemental sensors for sensing a plurality of variable operational factors relating to the operation of said internal combustion engine and including the step of adjusting the supplemental sensor signals from said plurality of supplemental sensors prior to the supplemental sensor signals thereof being received by said electronic control unit.

10. The method according to claim 8 wherein said supplemental sensor signals are manifold absolute pressure sensor signals.

11. The method according to claim 8 wherein said supplemental sensor signals are RPM sensor signals.

12. The method according to claim 8 wherein said supplemental sensor signals are engine temperature sensor signals.

13. The method according to claim 8 wherein said supplemental sensor signals are intake air temperature sensor signals.

14. The method according to claim 8 wherein said supplemental sensor signals are throttle position sensor signals.

15. The method according to claim 8 additionally including the step of monitoring the $O_2$ sensor signals produced by the $O_2$ sensor, said step of adjusting the supplemental sensor signals being carried out in response to changes in said monitored $O_2$ sensor signals.

* * * * *